US005350072A

United States Patent [19]

Rogers et al.

[11] Patent Number: 5,350,072

[45] Date of Patent: Sep. 27, 1994

[54] RESIDENTIAL INTEGRAL SHELF AND HANGER ROD

[75] Inventors: Richard D. Rogers; Charles Camilleri, both of St. Louis; Raymond Wood, Fenton, all of Mo.

[73] Assignee: Lee Rowan Company, St. Louis, Mo.

[21] Appl. No.: 48,116

[22] Filed: Apr. 14, 1993

Related U.S. Application Data

[63] Continuation-in-part of Ser. No. 966,274, Oct. 26, 1992, which is a continuation of Ser. No. 771,763, Oct. 4, 1991, abandoned.

[51] Int. Cl.[5] ..... A47F 5/00

[52] U.S. Cl. ..... 211/123; 211/94; 211/106; 211/162; 211/181

[58] Field of Search ..... 211/90, 94, 105.1, 106, 211/123, 162, 181

[56] References Cited

U.S. PATENT DOCUMENTS

| | | | |
|---|---|---|---|
| 505,360 | 9/1893 | Hilliard . | |
| 1,391,495 | 9/1921 | Parsons . | |
| 1,576,784 | 3/1926 | Planett . | |
| 2,271,784 | 2/1942 | Tritt . | |
| 2,612,273 | 9/1952 | Smith . | |
| 2,788,885 | 4/1957 | Begent . | |
| 2,859,879 | 11/1958 | Rogers et al. . | |
| 2,870,916 | 1/1959 | Bonia et al. . | |
| 3,141,556 | 7/1964 | Klosterman . | |
| 3,225,940 | 9/1964 | Story . | |
| 3,598,064 | 8/1971 | Stempel . | |
| 3,688,915 | 9/1972 | Ramsey . | |
| 4,316,593 | 2/1982 | Miner et al. . | |
| 4,493,423 | 1/1985 | Kaeslin et al. . | |
| 4,671,419 | 6/1987 | Beverly . | |
| 4,762,238 | 8/1988 | Blanchard | 211/123 |
| 5,050,750 | 9/1991 | Mason . | |

FOREIGN PATENT DOCUMENTS

| | | |
|---|---|---|
| 2007991 | 9/1971 | Fed. Rep. of Germany . |
| 1251070 | 12/1960 | France . |
| 2562777 | 10/1985 | France . |
| 164969 | of 1957 | Sweden . |

*Primary Examiner*—Alvin C. Chin-Shue
*Assistant Examiner*—Derek J. Berger
*Attorney, Agent, or Firm*—Rogers, Howell & Haferkamp

[57] ABSTRACT

An integral wire shelf and hanger rod having a plurality of support brackets for interconnecting the rod with metal shelf. Each support bracket has a U-shaped section and spaced upper and lower arms welded respectively to the shelf and the hanger rod. The configuration of the support brackets permits a garment hanger to slide across the rod through a path uninterrupted by the support brackets.

8 Claims, 3 Drawing Sheets

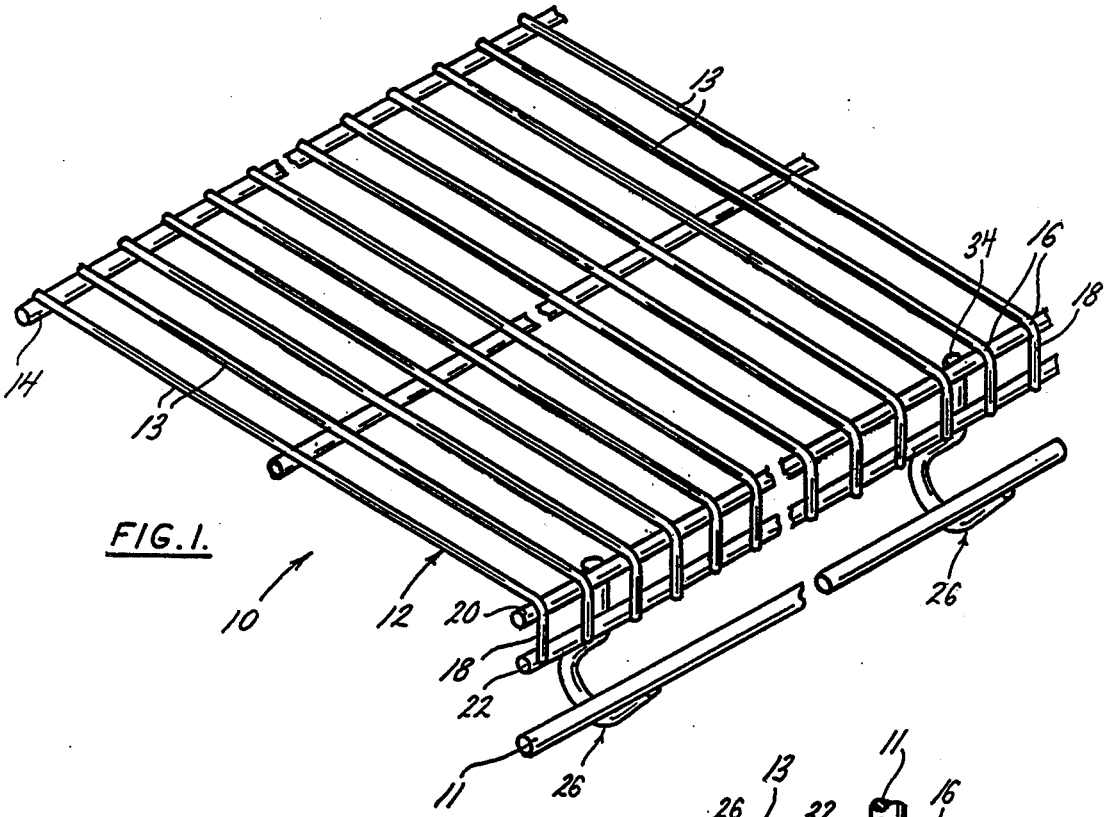
FIG. 1.
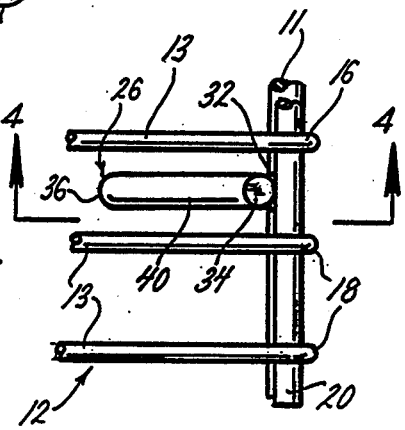
FIG. 2.
FIG. 3.
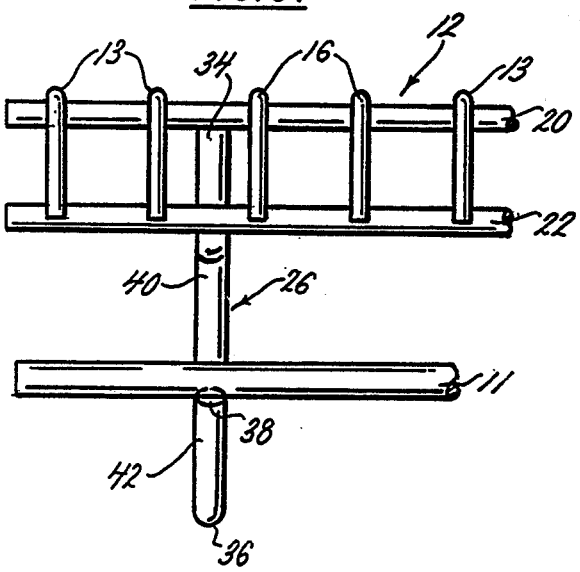
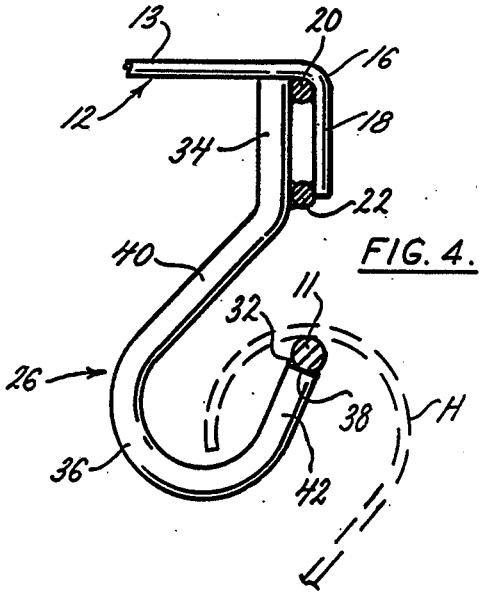
FIG. 4.

FIG. 5.
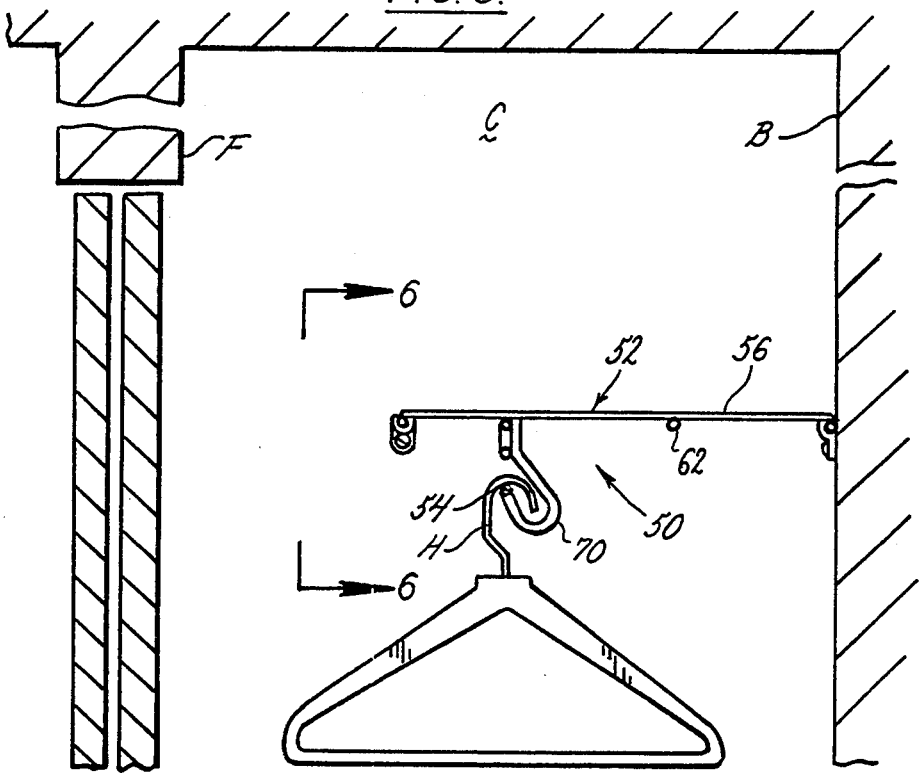
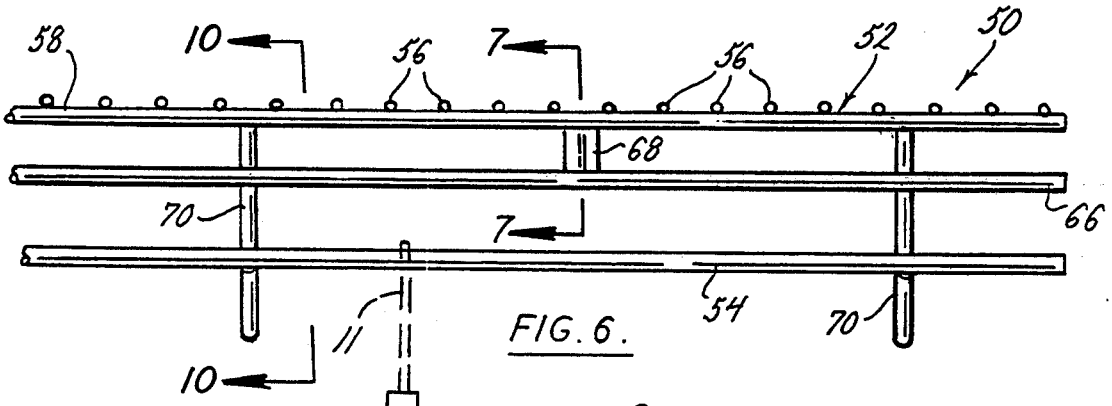
FIG. 6.
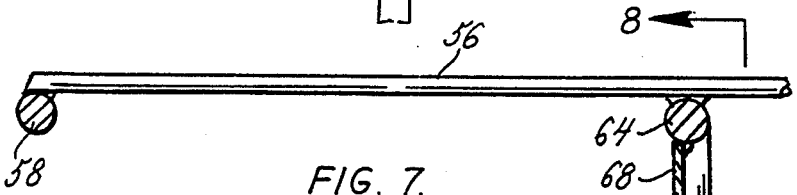
FIG. 7.
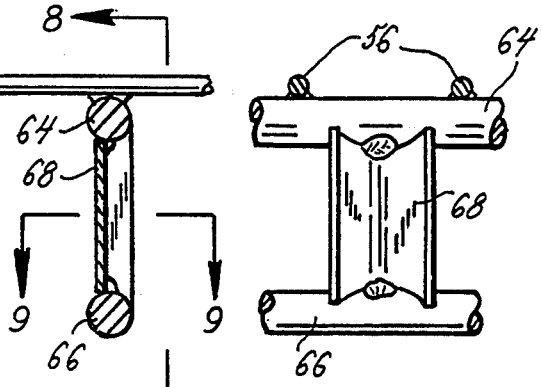
FIG. 8.
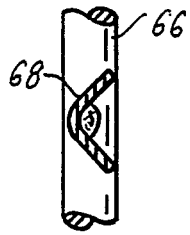
FIG. 9.

RESIDENTIAL INTEGRAL SHELF AND HANGER ROD

This application is a continuation-in-part of application Ser. No. 07/966,274 filed Oct. 26, 1992, pending, which in turn is a continuation-in-part of application Ser. No. 07/771,763 filed Oct. 4, 1991, now abandoned.

BACKGROUND OF THE INVENTION (1) Field of the Invention

This invention relates to shelving and garment hanger rods of the kind used in household closets and the like and particularly to a small gauge wire or rod shelf and hanger rod connected together by support brackets. Specifically, this invention relates to such a combination that allows uninterrupted sliding of garment hangers along the hanger rod.

(2) Description of the Related Art

Garment hangers typically have hooks by which the hangers are hung on a rod while supporting garments. It is commonly recognized that, for convenience, garment supporting hangers should be freely slidable on the hanger rod on which the hangers are hung and the closet rod should resist sagging when fully loaded. This free and uninterrupted slidability is desirable because, as hangers are added to and removed from a hanger rod, and to view the garments in a closet, the hangers must be slid along the hanger rod.

For many decades a typical residential clothes closet has been equipped with a wooden shelf installed above a wood or pipe hanger rod. Free slidability of garment hangers has been accomplished by making the wood and pipe rods of large enough diameter (usually greater than one inch) that they can be supported only at their ends without intermediate supports. For an exceptionally long large closet rod, minimal interruption of the coat hangers is afforded by only occasional, distantly spaced brackets for supporting such a large diameter hanger rod. However, these larger hanger rods have the disadvantage of being independent of a closet shelf and being relatively expensive. The rods of wood tend to sag, increasingly over a period of time, and the rods of pipe are heavy and more difficult to install.

In more recent years wire shelving has become popular for residential use, often selected in place of wood. A typical wire shelf consists of spaced longitudinal rods extending left to right and smaller diameter wires extending transversely over the longitudinal rods, front to rear, and welded to the rods. For either a twelve inch or a sixteen inch deep shelf, there may be a pair of vertically spaced front rods and a rear rod, with one or more intermediate rods between the front and rear. Typically, the wires are spaced on about one inch centers extending over the tops of the rods front to rear. On some shelves the wires are turned down at their fronts to provide front flanges welded to the vertically spaced front rods. The rods have been about 3/16 to 5/16 inch in diameter and the wires about 3/32 to ⅛ inch in diameter. A popular shelf has had rods of slightly less than ¼ inch diameter and wires of a little less than ⅛ inch diameter.

An inexpensive and convenient-to-install integral shelf and hanger rod formed of metal wires and rods welded together is also commercially available. These integral shelf and hanger rod units typically are packaged with installation hardware and sold through retail outlets. Both builders and do-it-yourself consumers can readily install these integral shelf and hanger rod units, usually in residential closets. In these integral shelf and hanger rod units there are longitudinal wires or rods each of about 3/16 to 5/16 inch diameter extending along the front and rear of the shelf. Smaller gauge transverse wires or rods of about 3/32 to ⅛ inch diameter are closely spaced in parallel, front to rear orientation and are welded to the larger longitudinal rods. A hanger rod is connected to the shelf by a plurality of vertical support rods. However, because the hanger rod, like the longitudinal shelf rods, is of about 3/16 to 5/16 inch diameter, the support rods must be spaced within a maximum of about one foot of each other to avoid sagging. With an adequate number of vertical support rods, typically at about one foot intervals, welded to the shelf and to the hanger rod, many garment supporting hangers can be hung from the hanger rod with minimum sagging. However, slidability of the garment hangers is obstructed by the vertical support rods and limited to about one foot spans. These obstructions to slidability created by the plurality of support rods have made use of the integral shelf and hanger rods highly inconvenient. Since a typical closet is about two feet deep, it is desirable that a hanger rod be about one foot from the rear of the closet, placing the rod about midway between the front and rear walls of the closet. Accordingly, the conventional integral shelf and hanger rod is about twelve inches deep.

In the residential market, a shelf and hanger rod that has been improved must be accompanied by low cost, ease of handling, and convenience of installation. Such a residential shelf and hanger rod cannot approach the cost of typical commercial or industrial apparatus because consumers will not buy it. The residential shelf and hanger rod must be light weight so it can be handled comfortably by an individual consumer. It must not be bulky. It must be adaptable for packaging for sale in consumer-targeted retail outlets. Its design must be adaptable to installation by one person with simple hardware using basic household tools.

Since the hanging garments may be quite heavy, the shelf, hanger rod, and the rods that connect the hanger rod to the shelf must cooperate in such a way that they will not sag under heavy loading. Yet they must meet the foregoing requirements for residential application and, pursuant to the present invention, the support rods must not obstruct the slidability of garment hangers on the rod. Accordingly, this invention provides an integral shelf and hanger rod that meets the requirements for application to the residential market while providing unobstructed slidability of coat hangers on the hanger rod.

SUMMARY OF THE INVENTION

The present invention provides an integral wire shelf and hanger rod combination that allows uninterrupted slidability of garment hangers on the hanger rod while retaining strength, durability, low cost, ease of installation and ease of manufacture.

The invention provides a transverse hanger rod for garment hangers and a plurality of support brackets connecting the hanger rod to a metal wire shelf. Each support bracket is in the form of a metal rod that has an upper arm, a lower arm, and a central U-shaped section. Both arms extend rearwardly and downwardly. The upper arm is welded to the shelf while the lower arm is welded to the rod. The configuration of the support brackets allows garment hangers to slide across the rod past the support brackets without being obstructed by them. The shelf is of small diameter metal wires similar to those used on conventional residential shelves. The hanger rod is a small diameter rod. The support rods also are of small diameter. Therefore, these components, integrally organized, do not sacrifice any of the traditional characteristics and advantages of small diameter residential wire shelving and metal hanger rods. Yet, the orientation and organization of the components is such that, while retaining all of such characteristics and advantages, hangers can be slid freely on the hanger rod without interruption.

In one embodiment, the support brackets and hanger rod are at the front of the shelf as is appropriate for a shelf that is about twelve inches deep. In a second embodiment, such as for a sixteen inch shelf, the support brackets and hanger rod are spaced from the front of the shelf and are about twelve inches from the back of the shelf. Both embodiments position the hanger rod about midway between the front and back of a closet that is about two feet deep.

BRIEF DESCRIPTION OF THE DRAWINGS

FIG. 1 is a perspective view of a representative section of one embodiment of the integral wire shelf and hanger rod of the present invention showing the front, left side and top;

FIG. 2 is an enlarged top plan view, with portions broken away, of a front portion of the integral wire shelf and hanger rod of FIG. 1;

FIG. 3 is a front elevation view of the integral wire shelf and hanger rod of FIG. 1;

FIG. 4 is a section view taken generally along the line 4—4 of FIG. 2 and with the hook portion of a coat hanger shown in dotted lines;

FIG. 5 is a side elevation view of the second embodiment of the integral wire shelf and hanger rod of the invention shown installed in a typical closet and with a coat hanger shown hanging from the hanger rod;

FIG. 6 is a front elevation view of a representative portion of the integral wire shelf and hanger rod viewed along the line 5—5 of FIG. 5;

FIG. 7 is a view in section on an enlarged scale taken generally along the line 7—7 of FIG. 6;

FIG. 8 is a partial view in section taken along the line 8—8 of FIG. 7;

FIG. 9 is a view in section taken along the line 9—9 of FIG. 7;

DESCRIPTION OF THE PREFERRED EMBODIMENT

Figure 10:
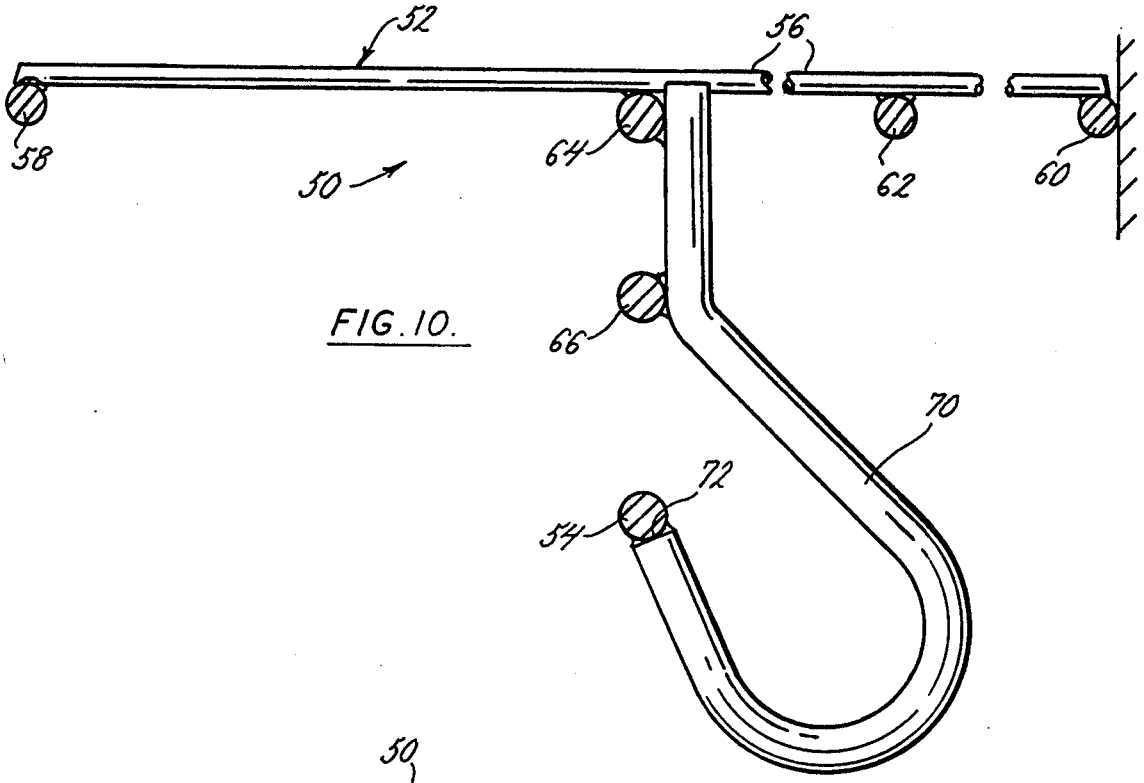
FIG. 10 is an enlarged view in section taken along the line 10—10 of FIG. 7.
Figure 11:
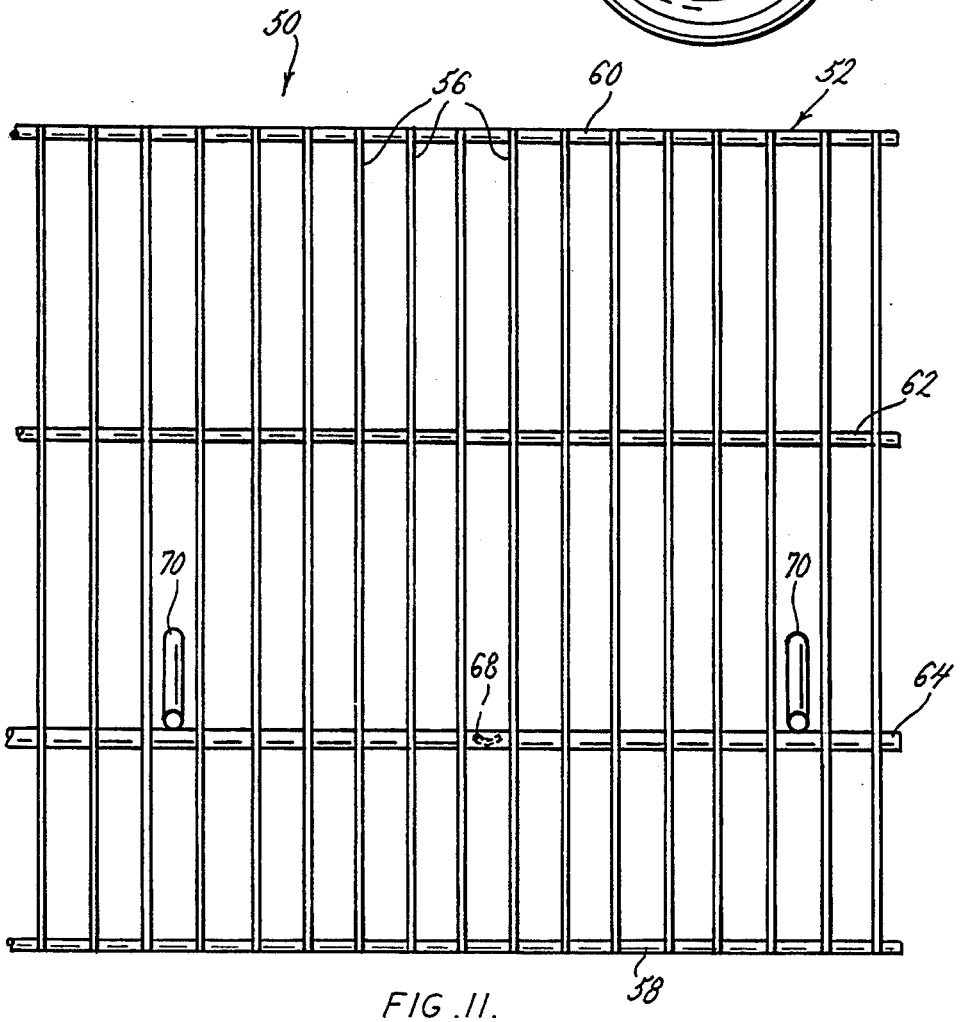
FIG. 11 is a top plan view of the integral wire shelf and hanger rod of FIG. 1.

With reference to FIG. 1, the integral shelf and hanger rod 10 of this invention has a coat hanger rod 11 that is combined with a wire frame shelf 12. The wire frame shelf 12 in this embodiment is about twelve inches deep for installation in a residential closet that typically is about two feet deep from front to back. The shelf 12 comprises a plurality of parallel, closely spaced wires 13 extending forwardly from the rear edges where they are welded to a wire or rod 14 at the back of the shelf. There may be a similar rod 15 parallel to the rod 14 and midway between the front and rear of the shelf. At the front of the shelf 12, the wires have 90° bends 16 and terminate in vertical turned-down flange portions 18. The turned-down flange portions 18 are welded to vertically spaced upper and lower rods 20 and 22. The hanger rod 11 is suspended below the lower shelf rod 22 by a plurality of support brackets 26. The configuration of these support brackets 26 is a special feature of this invention.

The support brackets 26 are connected to the rods 20 and 22 of the shelf and to the hanger rod by welds that provide strong load bearing connections. (See, for example, the welds 32 shown in FIGS. 2 and 4.)

The unique configuration of the support bracket 26 is generally a unitary wire or rod having a straight vertical shank 34 and a downwardly and rearwardly extending U-shaped portion 36 terminating at an end 38. The U-shaped portion 36 has two arms 40 and 42 of unequal length that are oriented as shown in FIG. 4 to position the hanger rod 11 directly below and in the vertical plane defined by the rods 20 and 22. This allows maximum front to rear depth of the shelf 12 because the coat hanger rod 11 is not located forward of the rods 20 and 22. It is the shank 34 which is welded to the rods 20 and 22 of the shelf. These two weld connections divide the load between the two rods 20 and 22. Also, the vertical alignment of the rod 11 with the rods 20 and 22 maximizes the load carrying capacity of the assembly.

Most importantly, the aforesaid configuration of the U-shaped portion 36 and the orientation and unequal lengths of the arms 40 and 42 assure the entire support bracket 26 will be cleared by a sliding coat hanger. Thus, as FIG. 4 clearly illustrates, the hook H of a coat hanger hung on the hanger rod 11 is located in unobstructed space and when slid along the hanger rod 11, the hook H never contacts any portion of the bracket 26. Therefore, even though the brackets 26 may be spaced apart by about twelve inches along the shelf 12 and coat hanger rod 11, many coat hangers can be hung on and slid along the coat hanger rod 11, and none of the hooks H will be obstructed by a support bracket.

The integral shelf and hanger rod 10 that has now been described retains the characteristics and advantages of residential wire shelves and hanger rods, including the incorporation of small diameter wire and rod components. These characteristics and advantages are maximized by the relative sizes and dimensions of the integral shelf and hanger rod 10. It has been determined that, for the shelf, the rear and middle rods 14 and 15 each can be about 0.225 inch in diameter, the vertically spaced front rods 20 and 22 each can be about 0.243 inch in diameter, and the wires 13, spaced on about one inch centers, each can be about 0.105 inch in diameter. flanges 18 of the wires 13, which are spaced from one another on about one inch centers, tie the two vertically spaced rods 20 and 22 together. As is known, when a downward load is applied to such a wire shelf, the lower rod 22 in particular is placed under tension. However, it has been determined that, in the combination of the present invention, the customary 1-5/16 inch vertical distance between rods corresponding to the rods 20 and 22 was not satisfactory. In the integral shelf and hanger rod 10, the vertical span between the centers of the rods 20 and 22 is about $\frac{3}{4}$ inch.

The rod that defines each support bracket 26 and the hanger rod 11 itself each can be about 0.243 inch in diameter. The shank 34 of each support bracket 26 is about 1-$\frac{1}{4}$ inch in length and is substantially vertical. The loop 36 is on about a $\frac{5}{8}$ inch radius the center of which is about 2-3/32 inch below the lower extent of the shank 34 and is about $\frac{5}{8}$ inch to the rear of the shank 34. The arm 40 that extends between the shank 34 and the loop 36 joins the shank 34 at a bend of about 3/16 inch radius. The other arm 42 is about 1-1/64 inch long and is at about a 30° angle to vertical, and the arm 42 positions the hanger rod 11 directly below and generally in the plane defined by the rods 20 and 22. The foregoing configuration of the support brackets will position the hanger rod 11 so that the clear space between the hanger rod 11 and the lower rod 22 is about 1-5/16 inch.

FIGS. 5–11 illustrate another embodiment of the invention. Here an integral shelf and hanger rod 50 has a wire frame shelf 52 and a coat hanger rod 54. The wire frame shelf 52 in this embodiment is about sixteen inches deep front to rear. Yet the integral shelf and hanger rod 50 is intended for installation in a residential closet of the normal two foot depth with the hanger rod 54 positioned midway between the front F and back B of the closet C.

The integral shelf and hanger rod 50 has a plurality of parallel closely spaced transverse wires 56 extending front to rear over a front longitudinal rod 58, a rearward longitudinal rod 60 at the back of the shelf 52, an intermediate rod 62, and a forward rod 64.

Spaced below the forward rod 64 is a lower forward rod 66 supported by the rod 64 by a plurality of angle braces 68 that are welded to both the forward rod 64 and the lower forward rod 66 as illustrated in FIGS. 7, 8 and 9. Preferably, the braces are spaced longitudinally on about one foot centers over the lengths of the rods 64 and 66.

Centered between each set of braces 68 is a support bracket 70 thus locating the plurality of support brackets 70 on about one foot centers longitudinally spaced along the lengths of the rods 64 and 66. The support brackets 70 are substantially identical to the support brackets 26 that have been described in connection with the embodiment of FIGS. 1 through 4 and therefore the detailed configuration of each support bracket 70 need not be repeated. The support brackets 70 are welded to the forward rod 64 and the lower forward rod 66 as illustrated particularly in FIG. 10, positioning the free end 72 of each support bracket 70 below and vertically aligned in a plane defined by the rods 64 and 66, also as illustrated in FIG. 10. The hanger rod 54 is welded to the lower free ends 72 of the support brackets 70.

The wires 56 each may be about 0.105 inch in diameter and may be on one inch centers, and each of the rods 58, 60 and 62 may be about 0.225 inch in diameter. For the integral shelf and rod 50, it has been found that the rods 64 and 66 preferably should be 0.3 inch in diameter, and the hanger rod 54 likewise may be about 0.3 inch in diameter. The distance between the centers of the rods 64 and 66 can be about 1-1/16 inch and the span between the centers of the lower forward rod 66 and the hanger rod 54 can be about 1.47 inch.

In use, the integral shelf and hanger rod 10 or 50 can be compactly packaged in different lengths corresponding to the more common residential closet sizes, each along with standard mounting hardware, typically in a rectangular cardboard carton. A number of the cartons can be stacked on a shelf in a typical retail outlet or the contents can be unpacked and a shelf and hanger rod 10 or 50 can be displayed to customers.

A customer can purchase an integral shelf and hanger rod 10 or 50 that will fit his closet or, if exact size is unavailable, he then can cut the integral shelf and hanger rod 10 or 50 to desired length by cutting the longitudinal rods with a hacksaw. The integral shelf and hanger rod 10 or 50 can be handled and installed easily by one person.

Once installed, the shelf 12 or 52 will support articles placed on it and the hanger rod 11 or 54 will support coat hangers in the manner illustrated in FIGS. 4 and 5. Because the hooks H of the coat hangers do not contact any portion of the support brackets 26 or 70, the coat hangers can be slid freely along the hanger rod 11 or 54 without obstruction.

While the present invention has been described by reference to a specific embodiment, it should be understood that modifications and variations of the invention may be constructed without departing from the scope of the invention defined in the following claims.

What is claimed is:

1. A residential integral shelf and hanger rod from which garment hangers can be hung by their hooks comprising:

a shelf member having a back and a front and being formed of longitudinal and transverse wires welded together, the longitudinal wires including parallel horizontally spaced forward and rearward wires;

the rearward wire being adjacent the back of the shelf and the forward wire being toward the front of the shelf relative to the rearward wire;

a lower forward wire spaced below and parallel to the forward wire;

an elongated garment hanger rod;

a plurality of support brackets connected to the forward wire; the lower forward wire, and the garment hanger rod;

the configuration of each bracket being non-linear and clearing the hook of a garment hanger whereby the garment hanger can slide along the garment hanger rod in an uninterrupted path that passes the support brackets;

all of the wires and the garment hanger rod having diameters of less than one half inch whereby the integral shelf and hanger rod can be handled and installed by one person in a residential closet; and, the longitudinal wires include an upper front wire spaced forward of the forward wire;

the transverse wires extending across and being welded to the forward, rearward and upper front longitudinal wires.

2. The shelf and hanger rod of claim 1 wherein: the diameters of the longitudinal wires are between about 0.200 inch and 0.350 inch, the diameters of the transverse wire are between about 0.085 inch and about 0.125 inch, and the diameter of the hanger rod is between about 0.250 inch and about 0.350 inch.

3. The shelf and hanger rod of claim 2 wherein the span between the forward and lower forward wires is between about 1-⅛ inch and about 1-5/16 inch.

4. The shelf and garment hanger rod of claim 1 wherein the diameter of each support bracket is between about 0.250 inch and about 0.350 inch.

5. A residential shelf and garment hanger rod installed in a closet comprising:

a wire-frame shelf member of lightweight construction suitable for residential use and having a forward portion and a rear edge;

the rear edge adapted to abut a back wall of the closet;

the forward portion having a generally vertical flange;

said flange having upper and lower parallel and coextensive metal rods disposed transversely thereon, the upper rod spaced above the lower rod and the two rods defining a vertical plane;

a garment hanger rod;

a plurality of rod support brackets, each having a shank and a U-shaped portion;

said shank being welded to both said parallel rods;

said U-shaped portion having a pair of arms including a lower arm and an upper arm;

said lower arm extending upwardly and forwardly and terminating in a load bearing connection with said garment hanger rod;

said U-shaped portion and its arms being oriented to locate said garment hanger rod in said vertical plane and spaced below the lower rod;

the configuration of said U-shaped portion and arms being coordinated so that a garment hanger, while suspended on said garment hanger rod, is provided with a path to slide along the garment hanger rod uninterrupted by the support brackets; and, the shelf has a front edge spaced forward of the vertical flange and the span between the front edge and back edge is substantially greater than half the depth of the closet in which the shelf and garment hanger rod is installed whereas the span between the flange and the back edge is about half the depth of the closet.

6. The shelf and garment hanger rod of claim 5 wherein the upper and lower rods each has a diameter of at least two tenths inch.

7. The shelf and garment hanger rod of claim 6 wherein the garment hanger rod has a diameter of at least about one fourth inch.

8. The shelf and garment hanger rod of claim 5 wherein the space between adjacent brackets is between about nine inches and about fifteen inches.

* * * * *